US007857097B2

(12) United States Patent
Evinger et al.

(10) Patent No.: US 7,857,097 B2
(45) Date of Patent: Dec. 28, 2010

(54) SCAFFOLDING APPARATUS AND METHOD

(76) Inventors: Patrick Evinger, 1306 Bayshire La., Herndon, VA (US) 20170; Chris Long, 16001 Berkeley Dr., Haymarket, VA (US) 20169

( * ) Notice: Subject to any disclaimer, the term of this patent is extended or adjusted under 35 U.S.C. 154(b) by 1103 days.

(21) Appl. No.: 11/270,836

(22) Filed: Nov. 10, 2005

(65) Prior Publication Data

US 2006/0124392 A1 Jun. 15, 2006

Related U.S. Application Data

(60) Provisional application No. 60/626,443, filed on Nov. 10, 2004.

(51) Int. Cl.
*A63B 27/00* (2006.01)

(52) U.S. Cl. ..... 182/134; 182/128; 182/130; 182/131; 182/133; 182/136; 182/141; 182/148

(58) Field of Classification Search ..... 182/128, 182/130, 131, 133, 134, 136, 141, 147, 148
See application file for complete search history.

(56) References Cited

U.S. PATENT DOCUMENTS 4,002,222 A * 1/1977 Bruno ..... 182/132
4,234,055 A 11/1980 Beeche
4,372,425 A 2/1983 Murphy
4,432,435 A 2/1984 Anderson
4,452,337 A 6/1984 Atzinger
4,463,828 A 8/1984 Anderson
4,583,618 A * 4/1986 Zimmerman ..... 182/223
4,586,844 A 5/1986 Hammonds et al.
4,597,471 A * 7/1986 Anderson ..... 182/136
4,805,735 A * 2/1989 Anderson ..... 182/138
4,815,563 A 3/1989 Puccinelli et al.
4,869,343 A * 9/1989 Anderson ..... 182/113
4,877,107 A * 10/1989 Anderson ..... 182/17
4,942,941 A * 7/1990 Anderson ..... 182/136
4,955,584 A * 9/1990 Anderson ..... 182/133
4,972,922 A 11/1990 Levine
5,042,615 A * 8/1991 Anderson ..... 182/136
5,259,478 A * 11/1993 Berish et al. ..... 182/136
5,884,725 A 3/1999 Reyland
5,975,241 A * 11/1999 Berish et al. ..... 182/136
6,015,028 A 1/2000 Smith
6,131,698 A 10/2000 Reyland (Continued)

OTHER PUBLICATIONS

Pump Jacks, www.lynnladder.com/products/LynLad/pumpjacks.htm, May 6, 2003.

(Continued)

*Primary Examiner*—Jerry Redman
(74) *Attorney, Agent, or Firm*—Hunton & Williams LLP

(57) ABSTRACT

An apparatus comprising a frame scaffold with a mechanically operated sliding support, as well as methods of assembling, using and disassembling a frame scaffold using the sliding support are disclosed. The apparatus provides for at least one individual to vertically ascend and/or descend along the perimeter of frame scaffold by mechanical operation. The operator of the apparatus is in close proximity to the scaffold. The apparatus does not require the support of an additional structure (i.e., it is self-supporting). The apparatus provides improved safety and efficiency in the assembly and disassembly of frame scaffold.

11 Claims, 7 Drawing Sheets

U.S. PATENT DOCUMENTS

| | | | | |
|---|---|---|---|---|
| 6,167,987 | B1 | 1/2001 | Jensen | |
| 6,182,791 | B1 | 2/2001 | Cope | |
| 6,311,800 | B1 | 11/2001 | St-Germain et al. | |
| 6,354,402 | B1 | 3/2002 | Masino | |
| 6,443,262 | B1 | 9/2002 | Karanouth | |
| 6,446,752 | B2 | 9/2002 | Philippe | |
| 6,450,481 | B1 | 9/2002 | Oxtoby | |
| 6,471,003 | B2 | 10/2002 | Wyse | |
| 6,554,102 | B2 | 4/2003 | Schwörer | |
| 7,475,856 | B2 * | 1/2009 | Riblet | 248/248 |
| 2005/0061581 | A1 * | 3/2005 | Morris | 182/82 |

OTHER PUBLICATIONS

"Scaffolding", www.tpub.com/ceb/78.htm May 7, 2003.
"Falcon Ladder & Scaffold Manufacturers—Scaffolding Products", www.falconladder.com/scaffolding.htm, Apr. 29, 2003.
"Falcon Ladder & Scaffold Manufacturers—Scaffolding Products", www.falconladder.com/rollingscaffolding.htm, Apr. 29, 2003.
"Falcon Ladder & Scaffold Manufacturers—Scaffolding Products", www.falconladder.com/frames.htm, Apr. 29, 2003.
"Falcon Ladder & Scaffold Manufacturers—Pump-Jack System", www.falconladder.com/pumpjack.htm, Apr. 29, 2003.
"Falcon Ladder & Scaffold Manufacturers—Trigger Sawhorses", www.falconladder.com/sawhorses.htm, Apr. 29, 2003.
"Falcon Ladder & Scaffold Manufacturers—Planks", www.falconladder.com/planks.htm, Apr. 29, 2003.
"Falcon Ladder & Scaffold Manufacturers—Accessories", www.falconladder.com/accessories.htm, Apr. 29, 2003.
Qual-Craft 2200 Pump Jack, www.northwestpowertool.com/tool_manufacturers/qualcraft/2200.htm, Apr. 29, 2003.
Light Duty Scaffold Frames, www.lynnladder.com/products/Vanguard/lightdutyframes.htm, Nov. 25, 2002.
Scaffolding eTool: Supported Scaffolds, www.osha.gov/SLTC/etools/scaffolding/supported/pumpjack.html, Apr. 29, 2003.
Standard Scaffold Frames, www.lynnladder.com/products/Vanguard/frames.htm, Nov. 25, 2002.
"Climbing Side Bracket", A-1 Plank & Scaffold Mfg., Inc., www.a1scaffold.com.

* cited by examiner

SCAFFOLDING APPARATUS AND METHOD

CROSS-REFERENCE TO RELATED APPLICATION

This application claims benefit to Provisional Application No. 60/626,443 filed Nov. 10, 2004, the disclosure of which is incorporated herein by reference in its entirety.

FIELD OF THE INVENTION

The present invention relates to a novel scaffolding apparatus and method that provides enhanced productivity and safety. The present invention provides an apparatus comprising a frame scaffold with a self-propelled mechanically-operated sliding support, as well as methods of assembling, using and disassembling a frame scaffold using the sliding support. In addition to its safety and efficiency enhancements, the apparatus does not require the support of an additional structure (i.e., it is self-supporting), thus allowing for a wide variety of uses that are unavailable to other scaffolding systems. The apparatus is a highly cost effective and flexible system.

BACKGROUND OF THE INVENTION

Every year numerous fatalities and serious injuries occur in the construction and building industry as a result of workers using many of the scaffolding systems that are widely available today. In particular, many workers are injured or killed when they fall during assembly of the scaffold. In addition to the issue of worker safety, the cost to businesses, and particularly small to mid-size contractors in the industry, of the significant safety deficiencies of many commonly used scaffolding systems is substantial.

Despite these safety issues, the need for some type of scaffolding systems is undeniable. As the working level of a structure rises above the reach of crew members on the ground, scaffolding systems, which are essentially temporary elevated platforms, are erected to support the crew members, their tools, and materials. Building construction and repair require scaffold both for internal use as well as for external use in order to permit workers to stand at an elevation above ground surface to do work on areas of a building that is not accessible otherwise. For instance, a scaffold system is utilized in the installation of aluminum siding, or applying a coat of paint on the exterior of buildings.

There are many different types of scaffold systems in use today. For example, two general types of scaffold in use are suspended scaffolds and supported scaffolds. Suspended scaffolds are platforms suspended by ropes, or other non-rigid means, from an overhead structure. Many of the fatalities and injuries due to workers falling, associated with scaffold systems in general, are due to suspended scaffolds in particular.

In general, simple frame scaffolds are structurally safer and more efficient than suspended scaffolds. Supported scaffolds generally include one or more platforms supported by outrigger beams, brackets, poles, legs, uprights, posts, frames, or similar rigid support. Supported scaffolds comprise frame or fabricated, mobile, tube and coupler and pole scaffolds. Supported scaffold systems range from simple frame scaffolds to highly complex systems which may incorporate a motorized lift system.

Where complex support scaffold systems would be cost prohibitive for small and mid-sized contractors, a simple frame scaffold is desirable. Fabricated frame scaffolds, for example, are perhaps the most common type of scaffold because they are versatile, economical, and easy to use. They are frequently used in one or two tiers by residential contractors or small commercial and office contractors. However, frame scaffolds are often difficult and time-consuming to erect, largely because of their reliance on manual assembly. As such, they also place workers at substantial risk, particularly during assembly.

Manual assembly commonly requires individual hanger brackets to be lifted off of supports on the frame scaffold by a worker and moved up to another set of supports. This requires the heavy wood planks on top of the hangers to be removed or lifted so the bracket may be removed and placed in a new position. This exposes several workers to either crushing injuries or falls. The crushing injury often results from the planks slamming down on the bracket or falling completely from the scaffold. A fall typically occurs when a worker goes off balance while moving the hanger bracket or planks.

Further, the individual hanger brackets are spaced approximately three feet apart, so the brackets may only be moved in 3-foot increments. This is highly restrictive. Workers are typically forced to improvise as the structure approaches a ceiling or soffit of a building or other overhead obstruction that presents an obstacle to raising the boards. This compromises efficiency, productivity and worker safety.

Various other forms of scaffolding are also problematic. For example, a ladder jack scaffold is a simple device consisting of a platform resting on brackets attached to a ladder. Ladder jacks are limited to very light applications. Tube and coupler scaffolds are so-named because they are built from tubing connected by coupling devices, such scaffold systems are cost-prohibitive for small construction companies. Due to their strength, they are frequently used where heavy loads need to be carried, or where multiple platforms must reach several stories high. Their versatility, which enables them to be assembled in multiple directions in a variety of settings, also makes them hard to build correctly. Pole scaffolds are a type of supported scaffold in which every structural component, from uprights to braces to platforms, is made of wood.

Mobile scaffolds are a type of supported scaffold set on wheels or casters, they are designed to be easily moved and are commonly used in jobs like painting and plastering, where workers must frequently change positions. The brackets are designed to be raised and lowered in a manner similar to an automobile jack. However, mobile scaffolds are restricted to low levels and thus are very limited in usefulness.

Pump jack systems represent an alternative to some of the scaffold systems described above. The pump jacks typically include support arms that hold planks on which the workers can stand on when moving up and down along the pump jack poles. FIG. 1 is an illustration of a scaffold system that utilizes pump jacks in which pump jack poles are anchored on the ground by pole anchors and attached to the wall of the structure that the work is being done on, by pump jack braces for support. Pump jacks are operated to move up and down the pump jack poles to the desired height. The worker raises the pump jacks up with the foot, and lowers it by hand-cranking it down with a handle. A platform, e.g. a plank is supported between the jacks, and its height is adjusted by pumping the jacks and hand-cranking a handle. For example, one such scaffold that has been previously disclosed in the literature is depicted in FIG. 1, which is provided merely for comparison. As shown in the Figure, the pump jack system is physically attached to the wall of a structure (other than a scaffold structure itself, and has pump jack poles that are 30 feet or lower in height.

Thus, current pump jack systems are restricted to certain applications because they must be secured to a wall or other structure for support. Moreover, pump jacks cannot be used by heavy contractors because they lack material storage capability. Pump jack systems only provide support for workers and some miscellaneous small tools. They also lack guardrails or fall protection for the workers. Therefore, the pump jack systems are highly limited in their usefulness.

Accordingly, most of the previously available systems which are in wide use today are deficient in terms of safety, efficiency, affordability or some combination thereof. Therefore, it would be highly desirable to have a scaffold system that remedies these deficiencies. In particular, it would be desirable to have a scaffold system that cost effectively mechanizes the process of assembling frame scaffolding, instead of relying upon inefficient and dangerous manual assembly. Further, it would be highly desirable to have a scaffold system that is not limited to movement of the brackets in three foot increments, but instead allows unlimited movement to maximize flexibility and easily allow the scaffolding to be adapted to any overhead environment.

The present inventions overcomes the deficiencies of previously disclosed scaffolding systems, by providing independently-supported scaffold system that allow a wide variety of uses, and by extending the height of the pump jack poles for the purposes of utilizing such a scaffold system in a variety of structures, the present invention also overcomes the cost associated in setting up large scaffold systems, the safety issues associated with suspended scaffolds, the inefficient, and time-consuming manner required to securing the scaffold system to a structure. The present invention provides all of the benefits of previously available systems without comprising on safety. Further, this is accomplished by the present invention in a simple, cost-effective manner as required by small and mid-sized contractors. Moreover, the present invention provides a more efficient system that allows for faster assembly and disassembly of the scaffolding.

SUMMARY OF THE INVENTION

The present invention provides a method and apparatus for a frame scaffold system. The present invention as described herein provides a reduction in the cost associated in setting up scaffold systems, the injuries and fatalities due workers falling, and the time required to securing the scaffold system to a structure.

An embodiment of the present invention utilizes apparatus that comprise at least one pair of opposable scaffold frames, wherein the at least one pair of opposable scaffold frames are being supported by at least one support brace; at least one vertical member coupled to the at least one pair of opposable scaffold frames by at least one clamp member; at least one sliding assembly moveable along the at least one vertical member, said at least one sliding assembly comprising a lever member operatively associated with a roller assembly, said roller assembly being engageably associated with the at least one vertical member; and at least one support surface rigidly affixed to the at least one sliding assembly.

In another embodiment of the present invention, it is disclosed a method and apparatus where a vertical member is coupled to a scaffold assembly; securing a mechanically-operable vertical member-sliding assembly unit to a portion of the scaffold assembly with a clamp member; and assembling the scaffold assembly while mechanically operating the mechanically-operable vertical member-sliding assembly unit to ascend or descend the scaffold assembly.

In another embodiment of the present invention, it is disclosed herein an apparatus includes a scaffold assembly comprising multiple levels of pairs of opposable scaffold frames joined and supported by cross braces; and a pump jack operatively associated with said frame scaffold.

DETAILED DESCRIPTION OF THE INVENTION

The following description is intended to convey a thorough understanding of the invention by providing a number of specific embodiments and details involving the structure and operation of a novel apparatus of the present invention. It should be understood, however, that the present invention is not limited to these specific embodiments and details, which are provided for exemplary purposes only. It should be further understood that one possessing ordinary skill in the art, in light of known apparatuses and methods, would appreciate the use of the invention for its intended purposes and benefits in any number of alternative embodiments, depending upon specific design and other needs.

The present invention provides a novel scaffold apparatus and method for efficiently, safely and cost-effectively assembling a frame scaffold system. Further, the present invention provides a scaffold apparatus, and method, that does not require any attachment to or support from another structure, hence, the apparatus is an independently-supported system. The present invention dramatically increases productivity and safety by mechanizing what was previously a completely manual process. The present invention does not rely on complex and expensive automatic or power source driven operation. In fact, no power source is required whatsoever. Only a moderate amount of force by the operator needs to be applied to operate the apparatus.

Figure 1:
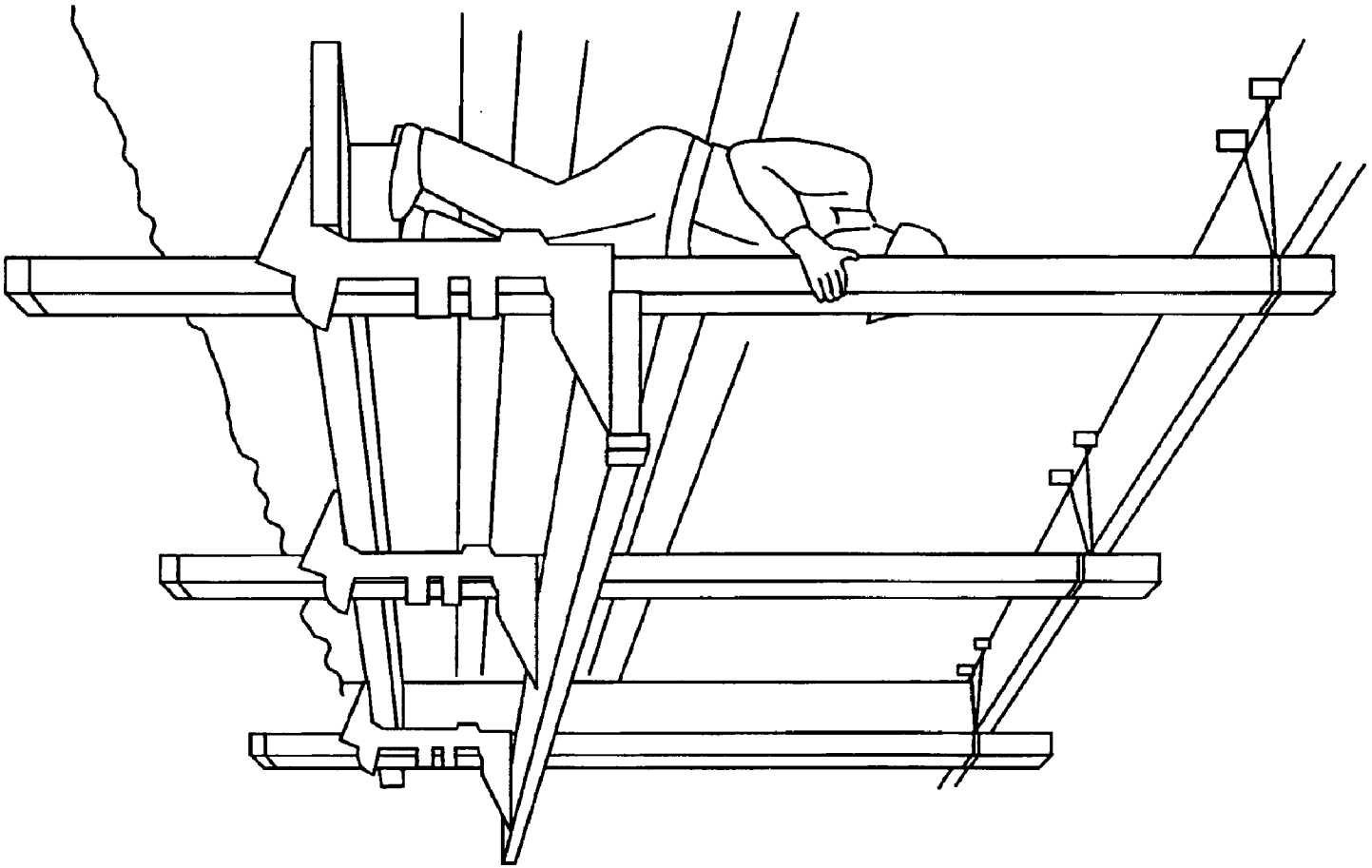
Prior Art FIGURE 1
FIG. 1 depicts a scaffold utilizing three pump jacks as disclosed on the website of Lynn Ladder for purposes of comparison with the present invention.
Figure 2:
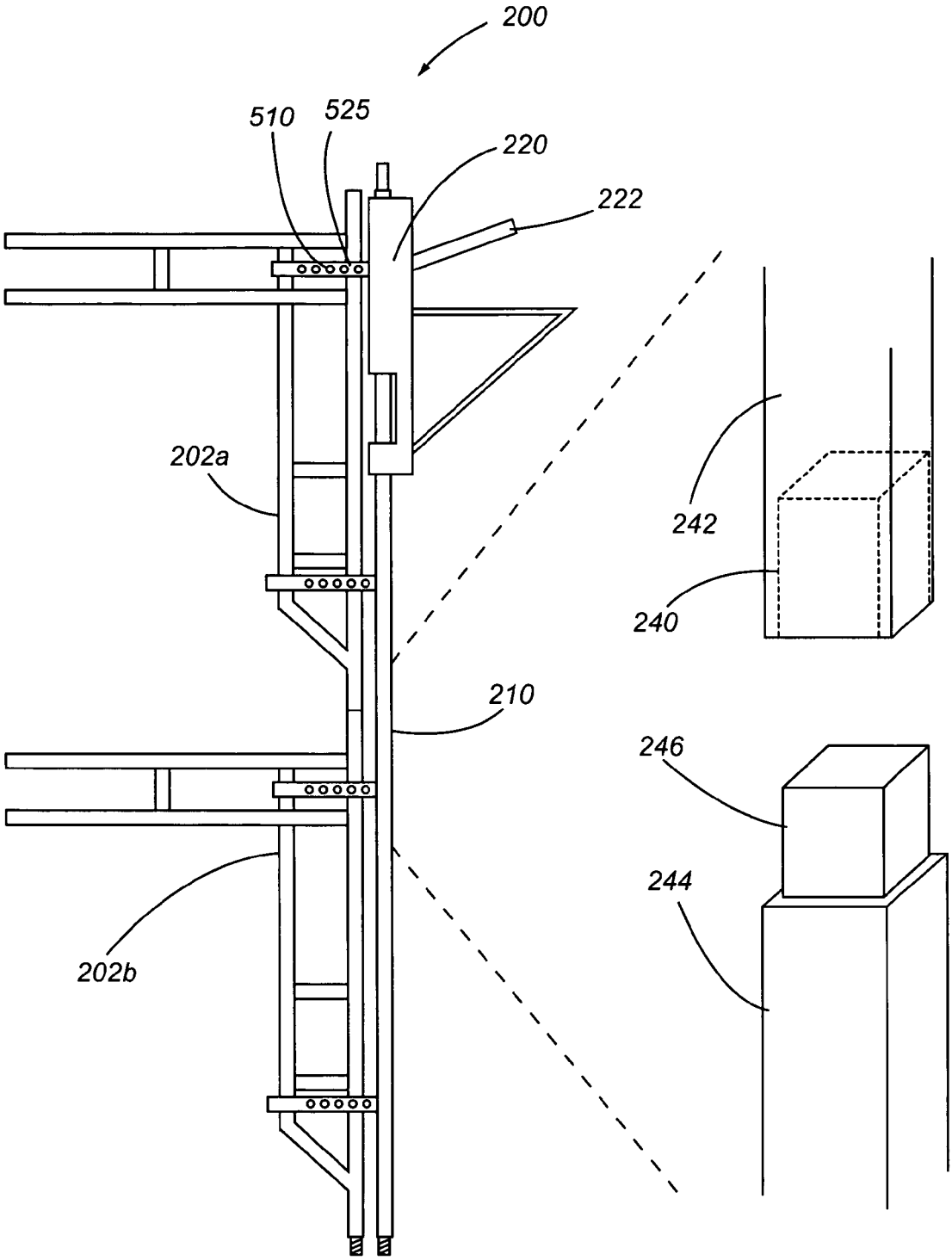
FIG. 2 depicts a side view of a two-pole frame scaffold utilizing pump jacks in accordance with an implementation of the present invention.

According to an embodiment of the present invention, as shown in reference to FIG. 2, a partial cutaway view of a scaffold system 200 is provided. The partial cutaway view shows a portion of scaffold frames 202*a* and 202*b* joined to each other. As this is only a partial cutaway view, not shown are the support braces and the opposing scaffold frames that would correspond to the two illustrated scaffold frames 202*a* and 202*b* as would be understood by a person skilled in the art.

Referring still to FIG. 2, vertical member 210 is operatively associated with sliding assembly 220. Sliding assembly 220 includes a lever 222 which may be moved in a downward and/or upward motion by an operator (not shown), for example, by a pumping action with the operator's foot, such as to engage and disengage a roller assembly (not visible) with the vertical member 210, which by force of friction allows the sliding assembly 220 to ride up and down the vertical member 220 and in close proximity to the scaffold frames 202*a* and 202*b*.

Referring still to FIG. 2, the vertical member 210 is made of any suitable material in any suitable shape or form, for example, a rectangular hollow aluminum tube where a hollow cavity 240, is indicated in the figure as a dotted line, and where a lower portion of the rectangular metal vertical member 244 has a connecting rail 246 that slides into the cavity of the upper portion 242.

Figure 7:
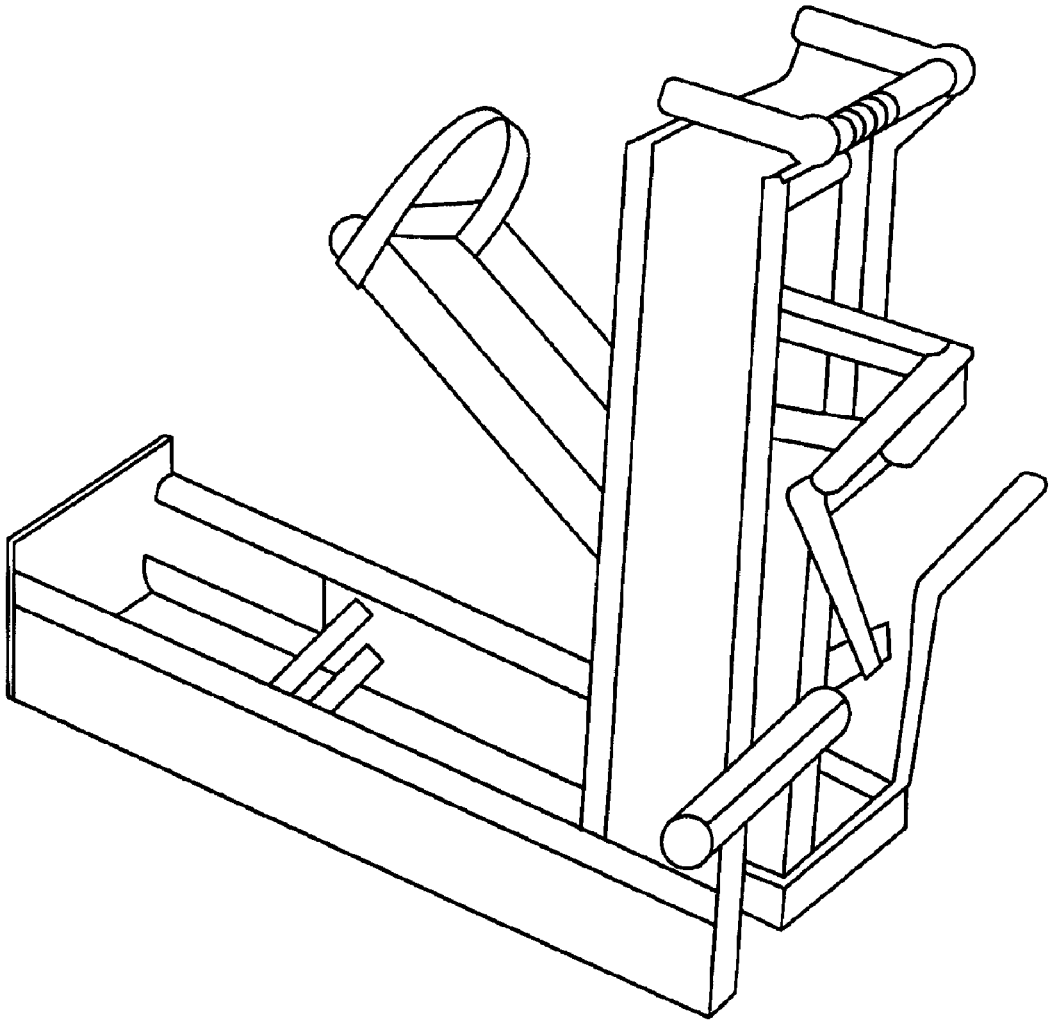
Prior Art FIGURE 7
FIG. 7 depicts a pump jack as disclosed on the website of Lynn Ladder for the purposes of comparison with the present invention.

According to an embodiment of the present invention, the sliding assembly 220 comprises a pump jack. For example, an exemplary pump jack is provided merely for purposes of illustration, as described in the web site of FalconScaffolds, a pump jack manufacturer and seller. See also FIG. 7 herein. Further, the pump jack may be of the type disclosed in U.S. Pat. No. 4,463,828. More specifically, and according to an embodiment, the pump jack comprises a vertical frame portion to which a horizontal platform support arm is attached. The pump jack includes a lower shackle portion and an upper shackle portion, each of which surrounds a vertical member, such as vertical member 210 of FIG. 2.

An upper roller portion, which provides a pivot support and which is attached to an upper clamping bracket surrounds the vertical member 210. In order to raise the sliding assembly 220 of the present invention up the vertical members 210, an operator places his foot on the lever 222, pressing it in a downward motion any number of times until the desired height is achieved. When the platform is to be lowered, the operator disengages the upper shackle, and then operates a spring-loaded handle, by continuously applying an unwinding downward motion, thereby, lowering the sliding assembly 220 and the platform attached thereto to the desired height. The operator stands on the platform while operating the lever and also as a work platform, e.g. to lay cinderblock, etc. In this manner, the operator can move up and down the workface in any increment and with relative ease compared to previously available systems within a low to moderate budget range.

Referring again to FIG. 2, the sliding assembly 220, comprises a lever member 222, operable by at least one operator in an upward and downward motion, and a roller assembly (not shown) to be engaged and disengaged with the vertical member 210 to allow the sliding assembly 220 to slide upward or downward along the vertical member 210. The lever member 222 may be operated in an upward and downward motion in any manner by the operator. For example, the lever may be foot-operated, hand-operated, knee-operated and the like, without limitation. Preferably, the lever is a foot-operated system.

Figure 3:
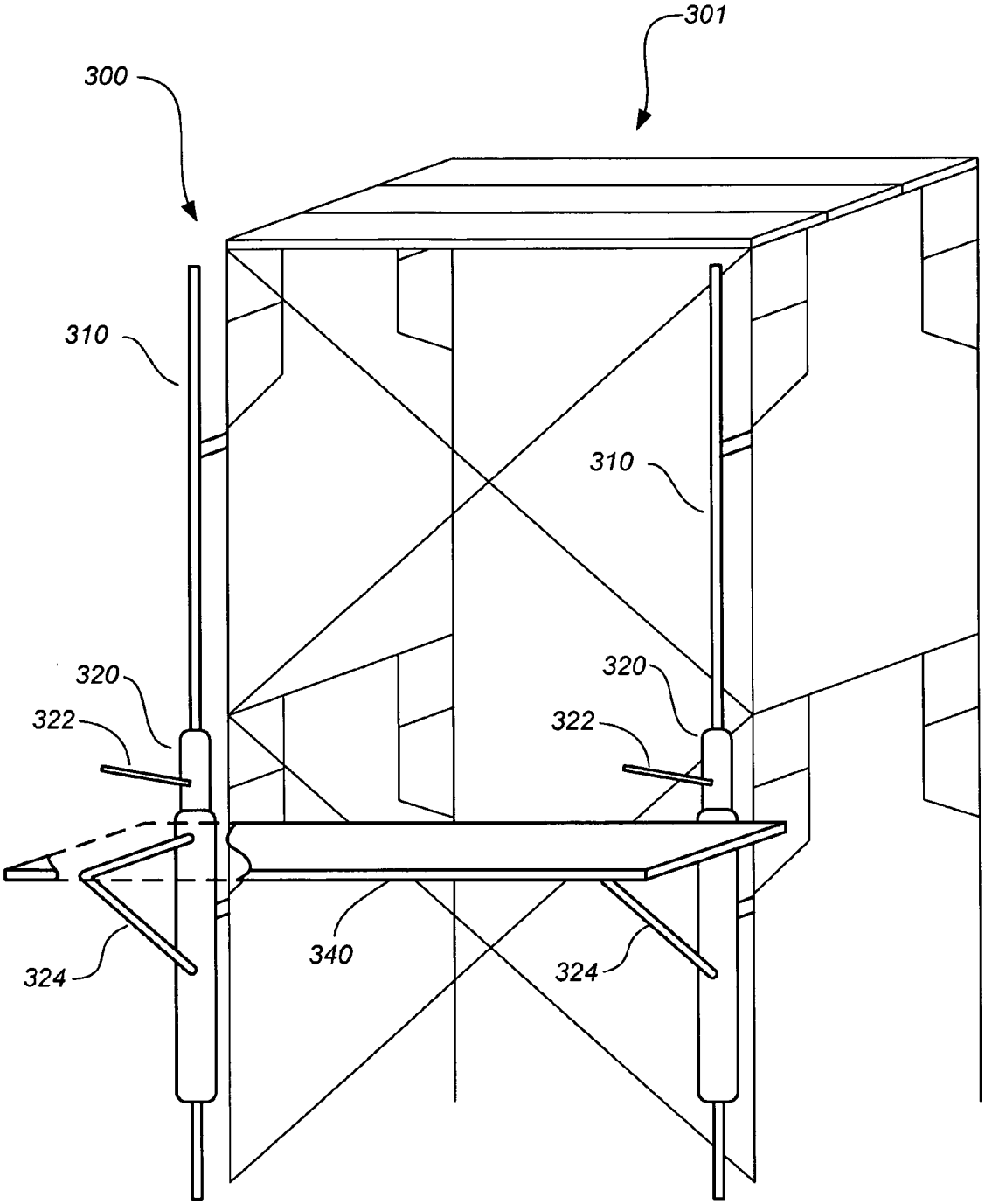
FIG. 3 is a frame scaffold system depicting opposable scaffold frames, a vertical member and a sliding assembly in accordance with an implementation of the present invention.

In accordance with an embodiment of the present invention, a frame scaffold system 300 is shown in FIG. 3. Vertical support members 310 are provided and are themselves supported by a scaffolding structure 301. At least one sliding assembly 320, is placed on the vertical member 310, having a lever member 322, which is engaged and disengaged by an operator in order for it to be vertically movable in an upward and downward direction along the length of the vertical member 310.

The sliding assembly 320, also incorporates a mounting bracket 324 to support a work surface 340. The work surface 340 provides a platform from which workers can stand or sit to perform various jobs, and also provides a platform for a person to operate the sliding assembly 320. One embodiment of the present invention provides that the mounting bracket 324 is of a triangular shape and is supported in a cantilever fashion from the sliding member 320. A work surface 340 is then preferably attached to the mounting bracket 324 by threaded fasteners (not shown), but may also be attached by clamps, welding, a combination thereof, or by other means known in the art.

Figure 4:
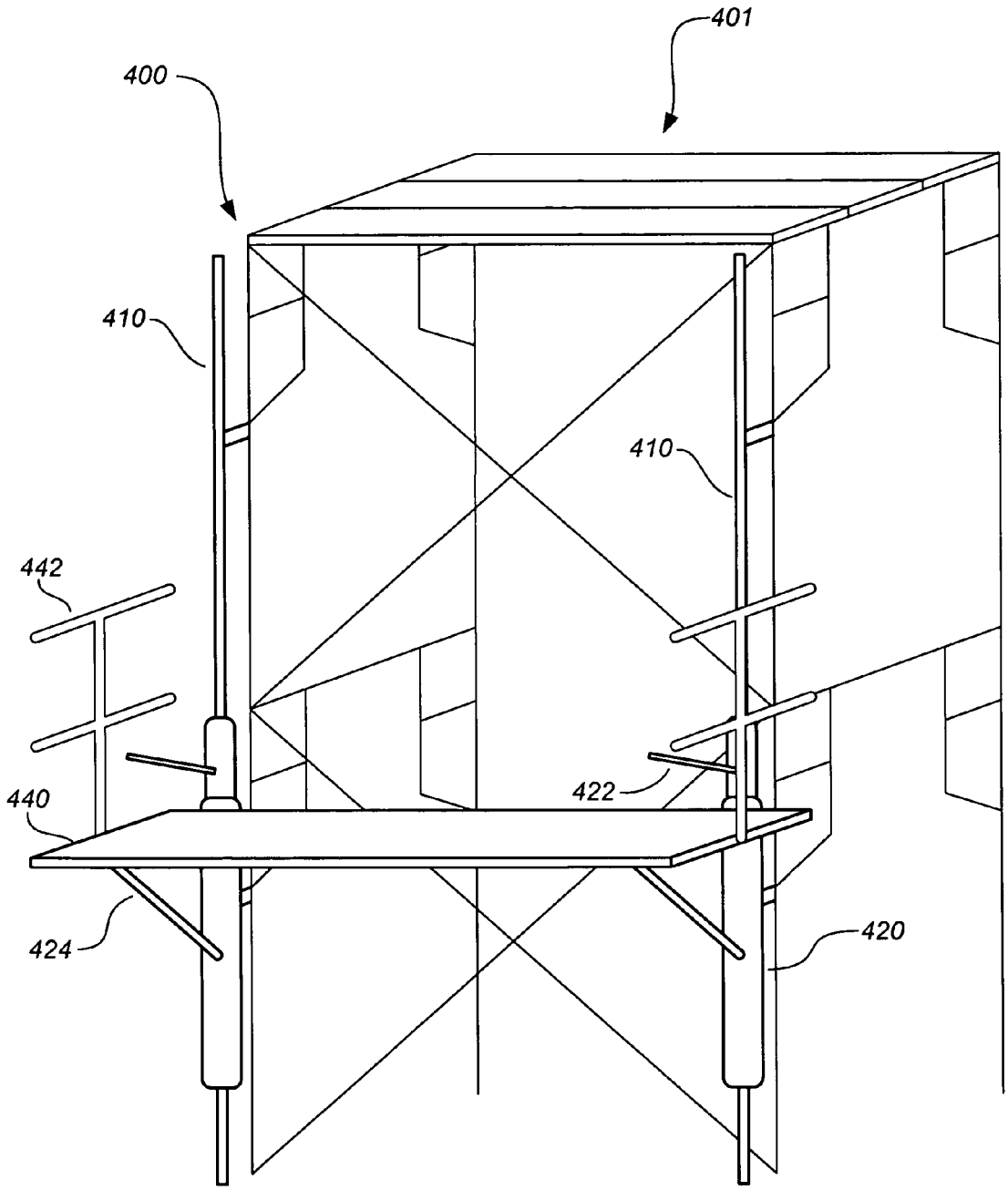
FIG. 4 is a frame scaffold system depicting opposable scaffold frames, a vertical member, a sliding assembly in accordance with an implementation of the present invention, and a work platform with a guardrail.

Referring to FIG. 4, the work surface 440 of the present invention also preferably incorporates a guardrail 442. The guardrail 442 is preferably attached to the work surface 440 by threaded fasteners (not shown), but may also be attached by clamps, welding, a combination thereof, or by other means known in the art. With the guardrail 442 attached to the work surface 440, the work surface 440 can be raised and lowered without disassembly of the guardrail 442. The guardrail 442 may also incorporate a gate (not shown) to allow ease of entry to the work surface 440. The guardrail may completely or partially encase the operator on the work platform, and in any manner, as safety and work conditions necessitate. A mounting bracket 424 is attached to the sliding assembly 420 and provides support for the work surface 440.

Referring still to FIG. 4, vertical support members 410 are provided and are themselves supported by a scaffolding structure 401. At least one sliding assembly 420, is placed on the vertical member 410, having a lever member 422, which is engaged and disengaged by an operator in order for it to be vertically movable in an upward and downward direction along the length of the vertical member 410.

In accordance with an embodiment, the apparatus permits at least one individual and preferably two or more individuals to vertically ascend and/or descend along the perimeter of frame scaffold, in close proximity to the scaffold. Unlike the pre-determined increments of previously available systems, movement to an unlimited number of positions in enabled. This permits a maximum amount of flexibility, particularly in terms of adapting to various challenging overhead environments. At the same time, the system is highly cost-effective and thus practical for projects that do not have a budget for large and complex electrically-powered systems.

The vertical members as described herein and depicted in the figures may be of any type suitable for the purpose of the present invention. A wide variety of shapes and sizes would be suitable to achieve the desired effect, as would be known to persons of skill in the art. The primary criteria for the selection of the type of vertical member relates to compatibility with the sliding assembly. For example, the vertical member may be a T-frame, an I-frame, a square post, a triangular post, a round pole or combinations thereof. Preferably, the vertical member is a square aluminum tube or an aluminum T-rail.

Figure 5A:
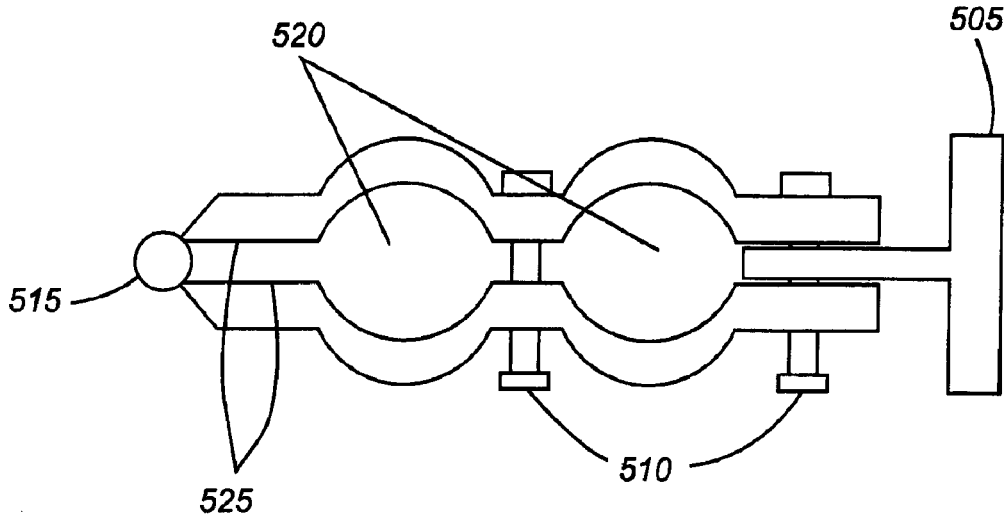
FIG. 5A depicts a top view of a clamp attachment to the scaffold in accordance with an implementation of the present invention.
Figure 5B:
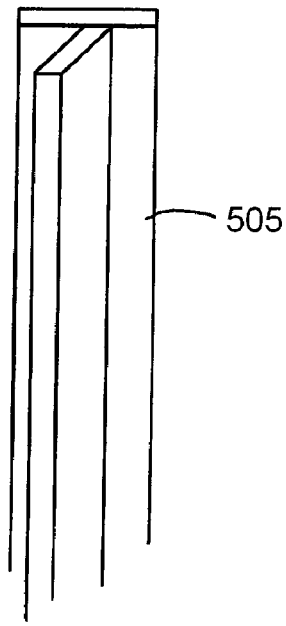
FIG. 5B is an illustration of a T-rail in accordance with an implementation of the present invention.

Referring to FIG. 5, embodiment A, a top view illustrates the coupling of a vertical member 505 (as represented by a T-rail, for example, without limitation) to scaffold legs 520*a* and 520*b* via clamp member 525. The clamp member 525 is held together on one end by a pair of screws 510 that are threaded for ease of attachment and adjustment, and on the other end, the clamp member 525 surrounds and secures a pair of scaffold legs 520. The clamp member 525 includes a hinge 515 to facilitate attachment and provide flexibility (e.g., based on various sizes, etc.). The vertical member 505 provides support for and allows a sliding assembly (not shown in the figure) to slide vertically upwards and downwards. FIG. 5, embodiment B is a side view of a vertical member which in the figure is represented by a T-rail provided merely for illustrative purposes while not intending to be limiting thereto.

Figure 6:
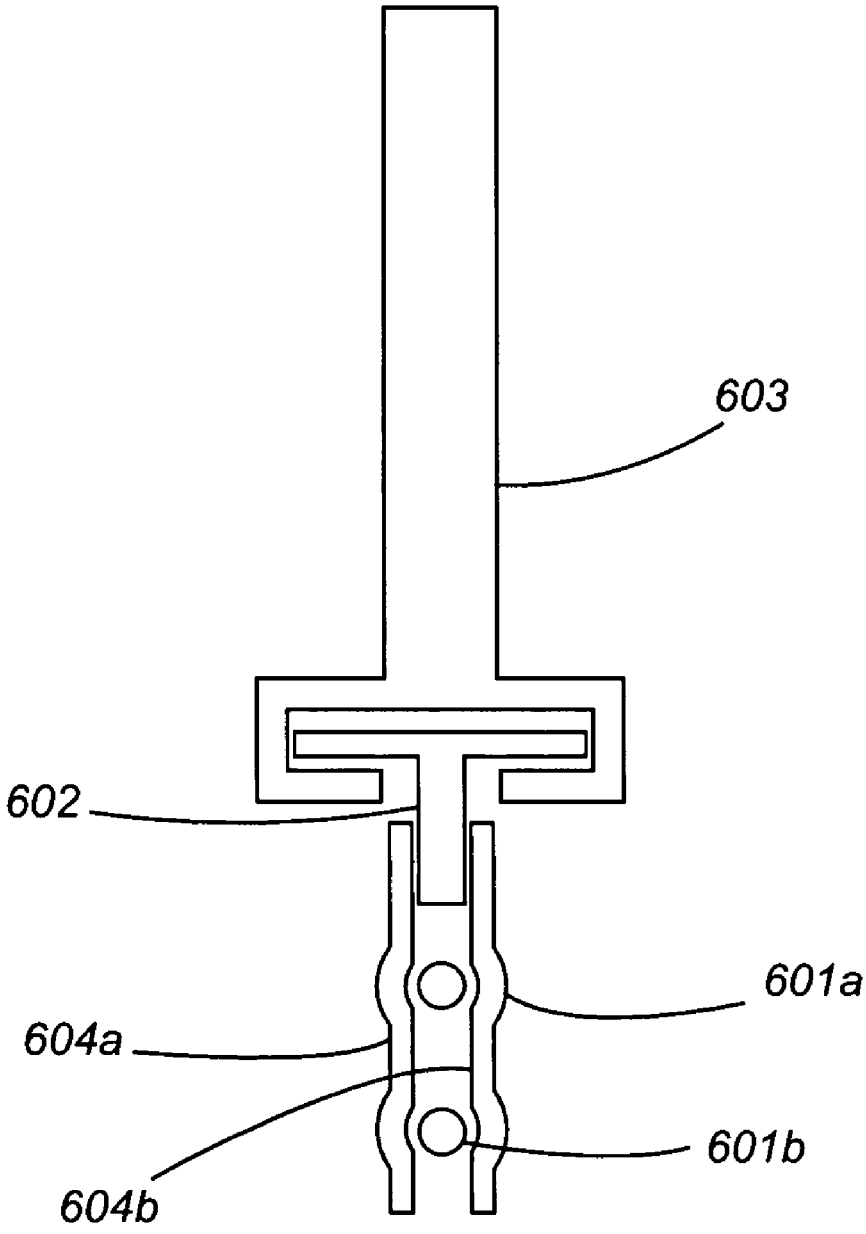
FIG. 6 depicts a top view of a pump jack/attachment assembly showing its connection to the scaffold legs in accordance with an implementation of the present invention.

Referring to FIG. 6, a T-rail 602 is attached to a pump jack 603 which is operatively associated with and adapted to said T-rail such that the pump jack 603 is able to slide vertically along said T-rail 602. The T-rail 602 is also attached to clamp members 604*a* and 604*b* that surround and grip a pair of scaffold legs 601*a* and 601*b* to secure the T-rail 602 to the scaffold structure, thereby allowing the pump jack 603 to move upwards and downwards in proximity to the scaffold in accordance with an implementation of the present invention.

The invention now being fully described, it will be apparent to one of ordinary skill in the art that many changes and modifications can be made thereto without departing from the spirit or scope of the invention as set forth herein. The foregoing describes the preferred embodiments of the present invention along with a number of possible alternatives. These embodiments, however, are merely for example and the invention is not restricted thereto. It will be recognized that various materials and modifications as to shape may be employed without departing from the invention described above, the scope of which is set forth in the following claims.

The invention claimed is:

1. An apparatus comprising:

a first frame scaffold system comprising a plurality of opposable scaffold frames, each pair of the plurality of opposable scaffold frames being supported by at least one support brace that attaches to and extends between each of said opposable scaffold frames, and each scaffold frame comprising two scaffold legs and a transverse support extending between the two scaffold legs; a second frame scaffold system attached vertically on top of said first scaffold system;

at least one vertical member coupled to the plurality of opposable scaffold frames by at least one clamp member; and extending from a bottom portion of the first scaffold system to a top portion of said second scaffold system at least one sliding assembly comprising a bracket that surrounds a portion of the vertical member to moveably attach the at least one sliding assembly to the at least one vertical member and allow the at least one sliding assembly to slide vertically upward and downward along an entire length of the at least one vertical member, said at least one sliding assembly comprising a lever member operatively associated with a roller assembly, said roller assembly being engageably associated with the at least one vertical member, wherein the roller assembly engages the vertical member when engaged by the lever member to move the at least one sliding assembly in the upward direction along the vertical member; and at least one work surface rigidly affixed to the at least one sliding assembly.

2. The apparatus of claim 1, wherein the at least one sliding assembly comprises a pump jack.

3. The apparatus of claim 1, wherein the at least one support surface supports the weight of at least one operator.

4. The apparatus of claim 1, wherein the lever member is capable of mechanical operation by an operator supported on the at least one support surface.

5. The apparatus of claim 1, wherein the plurality of opposable scaffold frames comprises three or more pairs of opposable scaffold frames in a vertically stacked configuration.

6. The apparatus of claim 5, further comprising two or more pairs of opposable scaffold frames in a horizontal configuration.

7. The apparatus of claim 6, wherein the at least one vertical member is coupled to the two or more pairs of opposable scaffold frames in the vertically stacked configuration and the sliding assembly is moveable along the entire length of the at least one vertical member.

8. The apparatus of claim 1, wherein the at least one vertical member is supported by the corresponding pair of opposable scaffold frames without external structural support.

9. The apparatus of claim 1, wherein the at least one vertical member is an Aluminum square tube.

10. The apparatus of claim 1, wherein the at least one vertical member is a T-frame.

11. The apparatus of claim 1, further comprising at least one additional sliding assembly moveably attached to at least one additional vertical member coupled to the first and second scaffold system.

* * * * *